US008517687B2

(12) United States Patent
Benjamin et al.

(10) Patent No.: US 8,517,687 B2
(45) Date of Patent: Aug. 27, 2013

(54) GAS TURBINE ENGINE COMPRESSOR AND TURBINE SECTION ASSEMBLY UTILIZING TIE SHAFT

(75) Inventors: Daniel Benjamin, Simsbury, CT (US); Lyubov Y. Belko, Granby, CT (US); Brian C. Lund, Moodus, CT (US); Marc J. Muldoon, Marlborough, CT (US); Eric Charles Mundell, South Berwick, ME (US); Daniel R. Kapszukiewicz, Plainfield, CT (US)

(73) Assignee: United Technologies Corporation, Hartford, CT (US)

( * ) Notice: Subject to any disclaimer, the term of this patent is extended or adjusted under 35 U.S.C. 154(b) by 649 days.

(21) Appl. No.: 12/720,712

(22) Filed: Mar. 10, 2010

(65) Prior Publication Data

US 2011/0223026 A1 Sep. 15, 2011

(51) Int. Cl.
*F01D 5/06* (2006.01)

(52) U.S. Cl.
USPC ..... 416/198 A; 416/204 A

(58) Field of Classification Search
USPC ..... 415/198.1, 199.4; 416/198 A, 198 R, 416/201 R, 204 A, 244 A
See application file for complete search history.

(56) References Cited

U.S. PATENT DOCUMENTS

| | | | | |
|---|---|---|---|---|
| 3,528,241 | A | | 9/1970 | Venable et al. |
| 3,823,553 | A | | 7/1974 | Smith |
| 3,914,070 | A | * | 10/1975 | Straniti ..... 416/201 R |
| 3,976,399 | A | | 8/1976 | Schmoch |
| 4,057,371 | A | | 11/1977 | Pilarczyk |
| 4,123,199 | A | | 10/1978 | Shimizu et al. |
| 4,247,256 | A | | 1/1981 | Maghon |
| 4,611,464 | A | | 9/1986 | Hetzer et al. |
| 4,915,589 | A | | 4/1990 | Gessler et al. |
| 4,934,140 | A | | 6/1990 | Dennison et al. |
| 4,944,660 | A | | 7/1990 | Joco |
| 5,220,784 | A | | 6/1993 | Wilcox |
| 5,537,814 | A | | 7/1996 | Nastuk et al. |

(Continued)

FOREIGN PATENT DOCUMENTS

| | | | |
|---|---|---|---|
| JP | 8-240127 | * | 9/1996 |
| WO | WO2007/051443 | * | 5/2007 |
| WO | WO2009/118036 | * | 10/2009 |

OTHER PUBLICATIONS

Klingels et al., Turbomachine Having a Tie Rod Consisting of Tension and Compression Sleeves, May 10, 2007, Machine translation of WO2007/051443.*

(Continued)

*Primary Examiner* — Edward Look
*Assistant Examiner* — Liam McDowell
(74) *Attorney, Agent, or Firm* — Carlson, Gaskey & Olds, PC

(57) ABSTRACT

A gas turbine engine has a compressor section carrying a plurality of compressor rotors and a turbine section carrying a plurality of turbine rotors. The compressor rotors and the turbine rotors are constrained to rotate with the tie shaft. An upstream hub provides an upstream abutment face for the compressor rotors. A downstream hub bounds the downstream end of the compressor rotor to bias the compressor rotors against the upstream hub using an abutment member. The downstream hub has a rearwardly extending arm which provides a stop for the turbine rotors. A second abutment member is tightened on the tie shaft to force the turbine rotors against the downstream hub to hold together the turbine rotors.

10 Claims, 2 Drawing Sheets

(56) References Cited

U.S. PATENT DOCUMENTS

| | | | | |
|---|---|---|---|---|
| 5,653,581 | A | 8/1997 | Dixon et al. | |
| 6,206,642 | B1 | 3/2001 | Matheny et al. | |
| 6,312,221 | B1 | 11/2001 | Yetka et al. | |
| 6,663,346 | B2 | 12/2003 | Munsell et al. | |
| 2010/0124495 | A1* | 5/2010 | Bifulco | 415/216.1 |
| 2010/0166559 | A1* | 7/2010 | Ahaus et al. | 416/198 A |
| 2010/0290911 | A1* | 11/2010 | Aschenbruck et al. | 416/198 A |

OTHER PUBLICATIONS

Suzuki et al., Gas Turbine and its Assembling Method, Sep. 17, 1996, Abstract of JP8-240127.*

* cited by examiner

GAS TURBINE ENGINE COMPRESSOR AND TURBINE SECTION ASSEMBLY UTILIZING TIE SHAFT

BACKGROUND OF THE INVENTION

This application relates to a method of assembling a gas turbine engine, wherein both a compressor rotors and the turbine rotors are assembled using a tie shaft connection.

Gas turbine engines are known, and typically include a compressor, which compresses air and delivers it downstream into a combustion section. The air is mixed with fuel in the combustion section and combusted. Products of this combustion pass downstream over turbine rotors, driving the turbine rotors to rotate.

Typically, the compressor section is provided with a plurality of rotor serial stages, or rotor sections. Traditionally, these stages were joined sequentially one to another into an inseparable assembly by welding or separable assembly by bolting using bolt flanges, or other structure to receive the attachment bolts.

More recently, it has been proposed to eliminate the welded or bolted joints with a single coupling which applies an axial force through the compressor rotors stack to hold them together and create the friction necessary to transmit torque.

SUMMARY OF THE INVENTION

A gas turbine engine has a compressor section carrying a plurality of compressor rotors and a turbine section carrying a plurality of turbine rotors. The compressor rotors and the turbine rotors are constrained to rotate together with a tie shaft. An upstream hub provides an upstream abutment face for the compressor rotors stack. A downstream hub bounds the upstream end of the compressor rotor and abuts the compressor rotor stack against the upstream hub. The downstream hub has a rearwardly extending arm which provides a stop for the turbine rotors. An abutment member is tightened on the tie shaft to force the turbine rotors against the downstream hub to axially retain the turbine rotors.

These and other features of the present invention can be best understood from the following specification and drawings, the following of which is a brief description.

DETAILED DESCRIPTION OF THE PREFERRED EMBODIMENT

Figure 1:
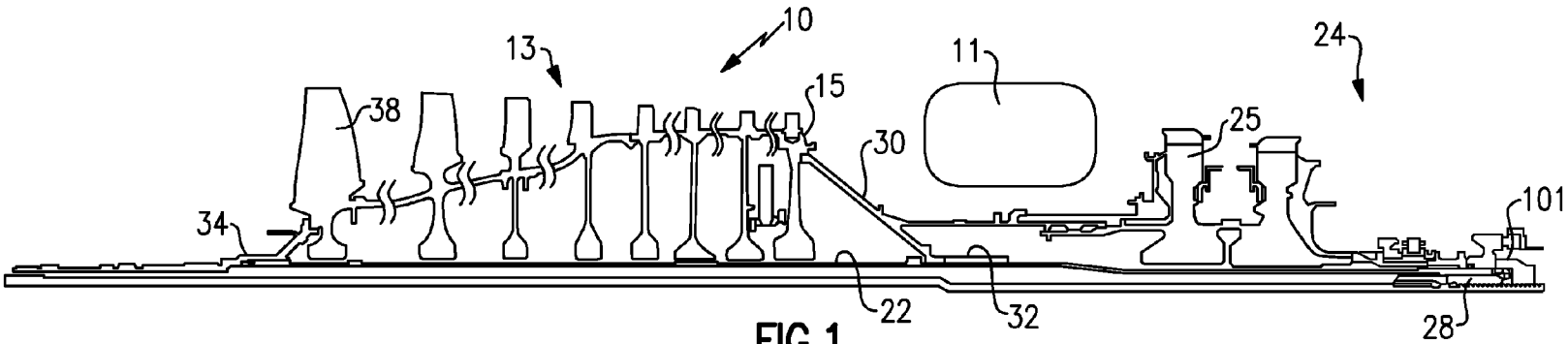
FIG. 1 schematically shows a gas turbine engine.

FIG. 1 schematically shows a gas turbine engine 10 incorporating a combustion section 11, shown schematically, a compressor section 13 having a plurality of compressor rotors 38, and a turbine section 24 having a plurality of turbine rotors 25. As shown, an upstream hub 34 is threadably secured to the tie shaft 22 at the upstream side of the compressor section 13. Notably, there may be a low pressure compressor, and a fan section, to the left of the upstream hub 34.

A downstream hub 30 is positioned at a downstream side of the compressor stack, and contacting a downstream-most compressor rotor 15. The stack of compressor rotors 38, 15 is sandwiched between the downstream hub 30 and upstream hub 34, and secured by a lock nut 32. Downstream hub 30 abuts the stack of turbine rotors 25, and holds them against a pair of lock nuts 28 and 101. Lock Nut 101 biases a plurality of seals and bearings 102 against the turbine rotors. All three lock nuts 32, 28 and 101 are threadably engaged to the same tie shaft.

Figure 2:
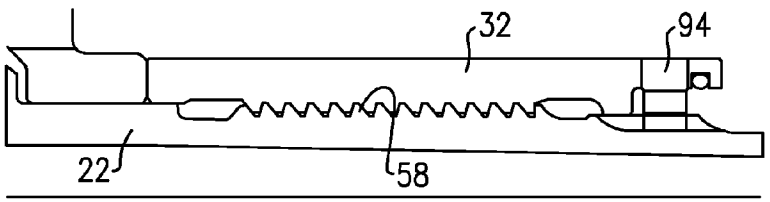
FIG. 2 shows a coupling nut for assembling the compressor.

As shown in FIG. 2, the nut 32 is threadably received on threads 58 on the tie shaft 22.

A lock washer 94 is also utilized for anti-rotation locking of nut 32.

Figure 3:
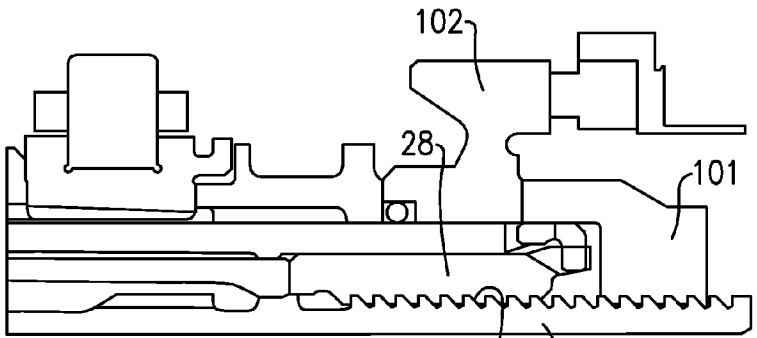
FIG. 3 shows a pair of nuts that are utilized to assemble the turbine section and the bearing stack.

FIG. 3 shows the nuts 101 and 28 threadably engaged to tie shaft 22. As can be seen, both nuts 28 and 101 are received on threads 58 on tie shaft 22.

Figure 4:
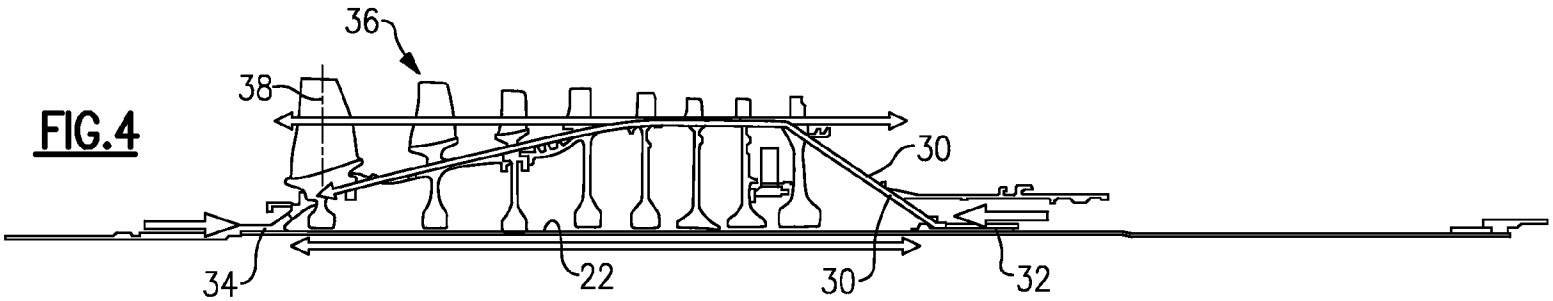
FIG. 4 shows the first assembly step.
Figure 5:
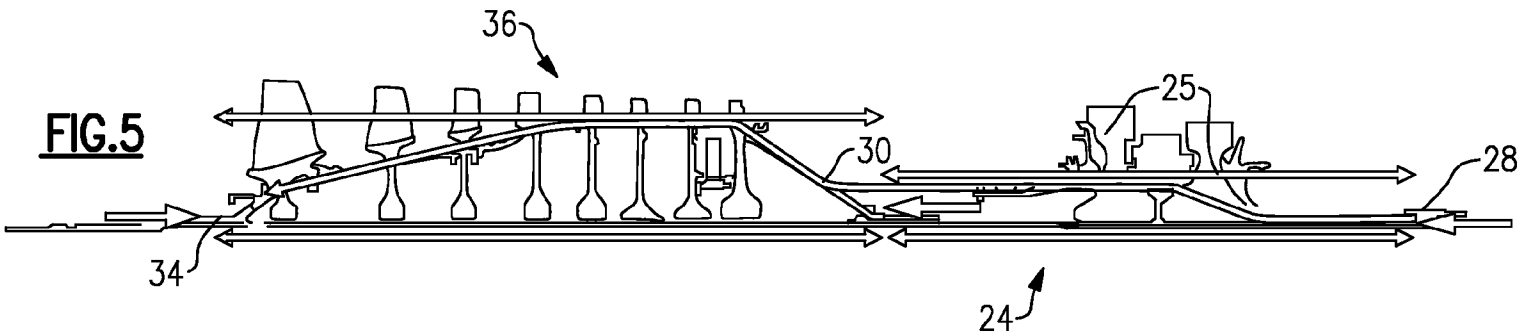
FIG. 5 shows the second assembly step.
Figure 6:
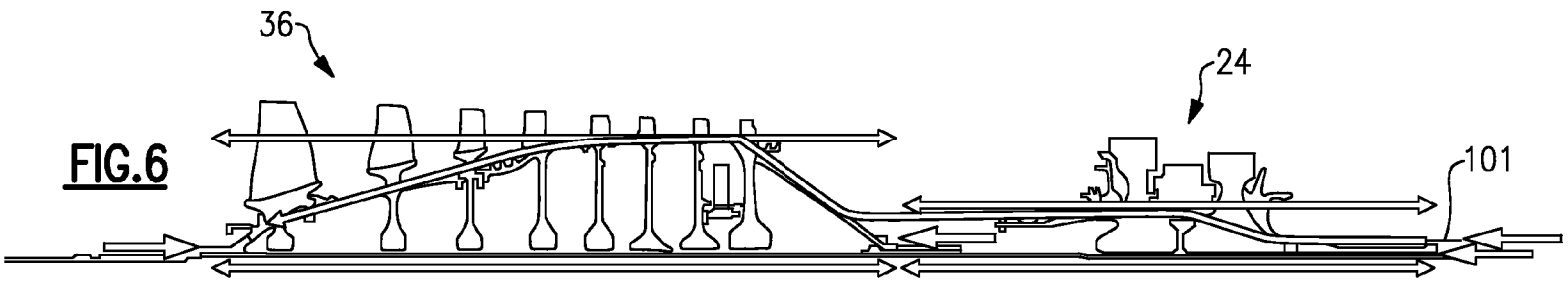
FIG. 6 shows the third assembly step.

FIGS. 4-6 show the assembly sequence of the gas turbine engine with the inventive arrangement. The single headed arrows as shown in these Figures illustrate an applied force, while the double-headed arrows illustrate internal forces. As shown in FIG. 4, initially, the upstream hub 34 is threadably assembled to the tie shaft 22 while the compressor rotors 38 and 15 and downstream hub 30 are stacked together using lock nut 32 to secure all of them by applying an axial pre-load force holding the rotors against the upstream hub 34 and ensuring the necessary friction to transmit torque. An internal compression load will be created in the rotors stack to react the tension load in the tie shaft 22.

As shown in FIG. 5, the subsequent step includes assembling the turbine rotors 25 to the compressor stack, and using lock nut 28 to secure the new assembly by applying an axial preload force holding the compressor and turbine rotors together and ensuring the necessary friction to transmit torque. A similar anti-rotation feature is included. A secondary load path is created with internal compression load in the turbine rotors stack and tension load in the downstream end of the tie shaft 22; the internal compression load in the compressor rotors stack is also augmented Finally, as shown in FIG. 6, the nut 101 is driven to hold the bearing and seal package 102 against the turbine rotors and augment the final stack preload to ensure the necessary friction to transmit torque. Again, an anti-rotation feature is included. A tertiary load path is created with internal compression load in the bearing stack and additional tension load in the downstream end of the tie shaft 22; the internal compression load in the compressor and turbine rotors stack is also augmented. Alternatively, the turbines can be held together by lock nut 28 alone.

This three-step arrangement ensures that the compressor and turbine sections are reliably held together, will be capable to resist the forces to be encountered during use and transmit the necessary torque. All these functions are accomplished within a minimal axial envelope and with the lowest locking hardware count.

Although embodiment of this invention have been disclosed, a worker of ordinary skill in this art would recognize that certain modifications would come within the scope of this invention. For that reason, the following claims should be studied to determine the true scope and content of this invention.

What is claimed is:

1. A gas turbine engine comprising:

a compressor section carrying a plurality of compressor rotors;

a turbine section carrying a plurality of turbine rotors;

said compressor rotors and said turbine rotors being constrained to rotate with a tie shaft;

an upstream hub providing an upstream abutment point for said compressor rotors, and a downstream hub abutting said compressor rotors to bias said compressor rotors against said upstream hub, said downstream hub having a rearwardly extending arm, said rearwardly extending arm providing a stop for said turbine rotors, and a downstream first abutment member at a downstream end of a downstream turbine rotor being tightened to force said turbine rotors against said downstream hub to hold said turbine rotors; and both said upstream hub and said downstream hub are provided with threaded members tightened to hold said compressor rotors together, a downstream one of said threaded members being tightened against said rearwardly extending arm.

2. The gas turbine engine as set forth in claim 1, wherein said downstream first abutment member includes a lock nut threaded to abut said tie shaft.

3. The gas turbine engine as set forth in claim 2, wherein a downstream second abutment member is positioned to hold a bearing and seal package against said turbine rotors, and apply a force through said turbine rotors.

4. The gas turbine engine as set forth in claim 3, wherein both said downstream first and second abutment members are threadably engaged to position said first and second abutment members.

5. The gas turbine engine as set forth in claim 2, wherein said compressor rotors are axial rotors.

6. The gas turbine engine as set forth in claim 2, wherein said tie shaft provides an axial preload to the compressor rotors that enables torque transmission between said compressor rotors.

7. The gas turbine engine as set forth in claim 2, wherein said downstream hub has a first arm extending radially outwardly from a location adjacent to said tie shaft to a contact end which contacts a downstream-most one of said compressor rotors, and said rearwardly extending arm extending from a radially intermediate portion between a radially inner and radially outer end of said downstream hub, and said rearwardly extending arm abutting an upstream-most one of said turbine rotors.

8. A gas turbine engine comprising:

a compressor section carrying a plurality of compressor rotors, said compressor rotors being axial rotors;

a turbine section carrying a plurality of turbine rotors;

said compressor rotors and said turbine rotors being constrained to rotate with a tie shaft;

an upstream hub providing an upstream abutment point for said compressor rotors;

a downstream hub abutting said compressor rotors to bias said compressor rotors against said upstream hub, said downstream hub having a rearwardly extending arm, said rearwardly extending arm providing a stop for said turbine rotors;

a downstream abutment member at a downstream end of a downstream turbine rotor being tightened to force said turbine rotors against said downstream hub to hold said turbine rotors;

said downstream abutment member includes a lock nut threaded to abut said tie shaft, said upstream hub and said downstream hub are provided with threaded members tightened on said tie shaft to hold said compressor rotors together, a downstream one of said threaded members being tightened against said rearwardly extending arm;

a second abutment member is positioned to hold a bearing and seal package against said turbine rotors, and apply a force through said turbine rotors;

said downstream hub has a first arm extending radially outwardly from a location adjacent to said tie shaft to a contact end which contacts a downstream-most one of said compressor rotors, and said rearwardly extending arm extending from a radially intermediate portion between a radially inner and radially outer end of said downstream hub, and said rearwardly extending arm abutting an upstream-most one of said turbine rotors; and said tie shaft provides an axial preload to the compressor rotors that enables torque transmission between said compressor rotors.

9. A method of assembling a gas turbine engine comprising the steps of:

(a) assembling a plurality of compressor rotors onto a tie shaft;

(b) assembling an upstream hub at an upstream end of said compressor rotors, and a downstream hub abutting said compressor rotors, said downstream hub having a rearwardly extending arm applying a bias force against said compressor rotors holding them against said upstream hub; and (c) assembling a plurality of turbine rotors onto said tie shaft, and a downstream abutment member being forced against a downstream one of said turbine rotors, and forcing said turbine rotors against said downstream hub to hold said turbine rotors.

10. The method as set forth in claim 9, wherein a second abutment member is tightened to hold a bearing and seal package against said turbine rotors, and apply a force to said turbine rotors.

* * * * *